US009550227B2

(12) United States Patent
Hirata

(10) Patent No.: US 9,550,227 B2
(45) Date of Patent: Jan. 24, 2017

(54) PRESS MOLDING MACHINE

(71) Applicant: TOYOTA BOSHOKU KABUSHIKI KAISHA, Aichi-ken (JP)

(72) Inventor: Kazuyuki Hirata, Toyota (JP)

(73) Assignee: TOYOTA BOSHOKU KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 14/563,158

(22) Filed: Dec. 8, 2014

(65) Prior Publication Data

US 2015/0158075 A1 Jun. 11, 2015

(30) Foreign Application Priority Data

Dec. 11, 2013 (JP) ..... 2013-256330

(51) Int. Cl.

| | |
|---|---|
| ***B21J 13/03*** | (2006.01) |
| ***B21J 5/02*** | (2006.01) |
| ***B21D 13/02*** | (2006.01) |
| ***B21D 37/02*** | (2006.01) |
| *B21J 13/02* | (2006.01) |

(52) U.S. Cl.

CPC ..... *B21J 13/03* (2013.01); *B21D 13/02* (2013.01); *B21D 37/02* (2013.01); *B21J 5/02* (2013.01); *B21J 5/025* (2013.01); *B21J 13/02* (2013.01)

(58) Field of Classification Search

CPC ..... B21J 13/02; B21J 13/03; B21J 5/02; B21J 5/022; B21J 5/025; B21D 13/02; B21D 37/02; Y02E 60/52

See application file for complete search history.

(56) References Cited

U.S. PATENT DOCUMENTS

| | | | | |
|---|---|---|---|---|
| 2,472,515 | A * | 6/1949 | Brinkoeter | B21D 37/02 72/475 |
| 7,279,016 | B2 * | 10/2007 | Allen | B21D 13/02 29/623.1 |
| 9,227,239 | B2 * | 1/2016 | Hirata | B21D 37/02 |
| 2007/0037033 | A1 * | 2/2007 | Chiba | H01M 8/0206 429/434 |
| 2008/0318114 | A1 * | 12/2008 | Lee | H01M 8/0206 429/437 |
| 2011/0300254 | A1 | 12/2011 | Wang et al. | |
| 2014/0352393 | A1 * | 12/2014 | Hirata | B21D 37/02 72/473 |
| 2014/0352394 | A1 * | 12/2014 | Hirata | B21D 37/02 72/478 |

(Continued)

FOREIGN PATENT DOCUMENTS

| | | | |
|---|---|---|---|
| CN | 2670024 | 1/2005 | |
| DE | 4213490 C1 * | 9/1993 | B21D 25/02 |
| JP | 61-255725 | 11/1986 | |

OTHER PUBLICATIONS

German Official Action with English translation for DE 10 2014 225 232.6, having a mailing date of Apr. 1, 2016.

*Primary Examiner* — Moshe Wilensky
*Assistant Examiner* — Pradeep C Battula
(74) *Attorney, Agent, or Firm* — Greenblum & Bernstein, P.L.C.

(57) ABSTRACT

Two press dies are formed by arranging a plurality of segments side by side to form die faces. The press dies are used to press a plate member. First and second joint portions are positioned differently between one of the press dies and the other of the press dies.

6 Claims, 11 Drawing Sheets

(56) References Cited

U.S. PATENT DOCUMENTS

2014/0352395 A1* 12/2014 Hirata ..... B21D 37/02
72/478
2015/0236358 A1* 8/2015 Hirata ..... H01M 8/0258
429/529

* cited by examiner

PRESS MOLDING MACHINE

BACKGROUND OF THE INVENTION

The present invention relates to a press die machine that is used in forming, for example, fuel-cell separators.

There is known a configuration shown in FIG. 10 as a separator used for a fuel cell. The separator is composed of a plate 41 made of a hard material such as titanium, and a plurality of first grooves 411 are formed on a first side face thereof at predetermined intervals. Further, a plurality of second grooves 412 are formed on a second side face on the opposite side of the first side face of the plate 41. Each second groove 412 is arranged between two adjacent first grooves 411. The first and second grooves 411, 412 of the plate 41 constitute respectively gas flow channels of fuel gas (hydrogen) and gas flow channels of oxidation gas (oxygen).

In the case of forming the above-described fuel-cell separator, a press die machine, for example, as shown in FIG. 11, has been conventionally used. The press die machine is provided with a lower die 43, which has an indented die face 431 on an upper face thereof and an upper die 44, which is arranged to move closer to or away from the lower die 43 and has on a lower face thereof an indented die face 441 corresponding to the die face 431 of the lower die 43. In a state in which a plate 41 as a workpiece is placed on the die face 431 of the lower die 43, the upper die 44 moves toward the lower die 43, by which first and second grooves 411, 412 are pressed on the plate 41 between the die faces 431, 441 of the both dies 43, 44.

In the case of manufacturing the lower die 43 and the upper die 44 of the above-described press die machine, a die material is subjected to cutting of the surface to form the indented die faces 431, 441. Where the die material is a super-hard metal material such as high-speed steel in the cutting, a cutting tool easily becomes dull. Therefore, it is difficult to cut indented patterns of the die faces 431, 441 along an extension direction of the indented patterns at one time by using a single cutting tool.

In order to cope with the above-described problem, a press die machine as shown in FIGS. 12 and 13 has been conventionally proposed. In this conventional machine, a lower die 43 is configured to be divided into a plurality of segments 45 formed in a square column shape, etc. These segments 45 are fitted into a frame 47 on a base 46 and arranged to be aligned in a length direction and in a width direction of the frame 47. A space member 48 is placed between each inner side-face of the frame 47 and corresponding segments 45. According to the above-described configuration, each of the segments 45, which are narrow in area, is subjected to cutting of an end face thereof to form an indented face, and the segments 45 are aligned to integrate the indented faces, thus making it possible to form the indented die face 431. Therefore, in this configuration, the die face 431 can be easily cut. As with the lower die 43, the upper die 44 is also formed by aligning the segments 45.

On the other hand, Japanese Laid-Open Patent Publication No. 61-255725 has disclosed a pressing machine in which a pair of upper and lower dies is used to simultaneously form a plurality of elbows flexed in a corrugated shape from a base pipe, with the elbows being adjacent continuously. In this pressing machine, both dies are configured to be divided into a plurality of segments, and each of the segments is provided with a die face having corrugated grooves. The base pipe is placed on a die face of the lower die, and the upper die is moved toward the lower die in a state in which a hydraulic pressure is applied inside the base pipe. Thereby, the elbows are simultaneously formed through pressing between the die faces of the both dies, with the elbows being adjacent continuously.

The above described conventional configurations have the following drawbacks.

In the conventional configuration described in FIGS. 12 and 13, joint portions 451 between two adjacent segments 45 are arranged to face each other between the both dies 43, 44. As shown in FIG. 13, when the plate 41 is pressed between the both dies 43, 44, a middle portion on a side face of each of the segments 45 of both dies 43, 44 is deformed to expand outward by a pressure applied at the time of pressing. The deformation of each segment 45 exerts a force that produces a gap between two adjacent segments 45. On the other hand, gaps on opposite sides of the plate 41, which is located between the both dies 43, 44, are positioned to correspond to each other. Therefore, stress acting on the plate 41 is changed abruptly at each joint portion 451 between two segments 45, thereby developing along the joint portion 451 a step 49 that is not necessary for the plate 41.

Further, the conventional configuration disclosed in the above-described Japanese Laid-Open Patent Publication No. 61-255725 is different from the machine filed in the present application not only in the shape of a workpiece to be pressed but also in the technical field of a product after being pressed, with no relationship found between the functions and use purposes. The machine disclosed in Japanese Laid-Open Patent Publication No. 61-255725 is to form a tubular elbow having an internal space between the upper and lower dies, and the upper die and the lower die face each other by way of a peripheral wall forming the elbow and fluid inside the elbow. Therefore, the conventional configuration disclosed in Japanese Laid-Open Patent Publication No. 61-255725 is free of any problem of the steps 49 developing on one plate as shown in FIGS. 12 and 13.

SUMMARY OF THE INVENTION

The present invention has been made focusing on the problems shown in the above-described conventional technologies. Accordingly, it is an objective of the present invention to provide a press die capable of restraining development of a step at a position on a plate member corresponding to a joint portion between any two adjacent segments when two press dies, each of which is formed by arranging segments side by side, are used to press the plate member.

To achieve the foregoing objective and in accordance with one aspect of the present invention, a press die machine for pressing a plate member is provided. The press die machine is provided with first and second press dies, each of which is formed by arranging a plurality of segments side by side for forming die faces. Joint portions of the first press die are formed between two mutually adjacent segments of the first press die. Joint portions of the second press die are formed between two mutually adjacent segments of the second press die. When the respective die faces of the first and second press dies face each other, the joint portions of the first press die and the joint portions of the second press die are arranged to be offset from each other.

According to the above-described configuration, between the press dies, a joint portion between two adjacent segments of one of the dies is not arranged to correspond to a joint portion between two adjacent segments of the other of the dies but arranged to be at a different position. Thereby, even where a middle portion on a side face of each segment of the press dies is deformed to expand outward at the time of pressing a plate member, no gap is developed between segments at corresponding positions in the press dies on both sides of the plate member. It is, therefore, possible to restrain development of a step on the plate member along the joint portion between the segments.

DETAILED DESCRIPTION OF THE PREFERRED EMBODIMENTS

First Embodiment

A press die machine according to a first embodiment will now be described with reference to FIGS. 1 to 5.

Figure 1:
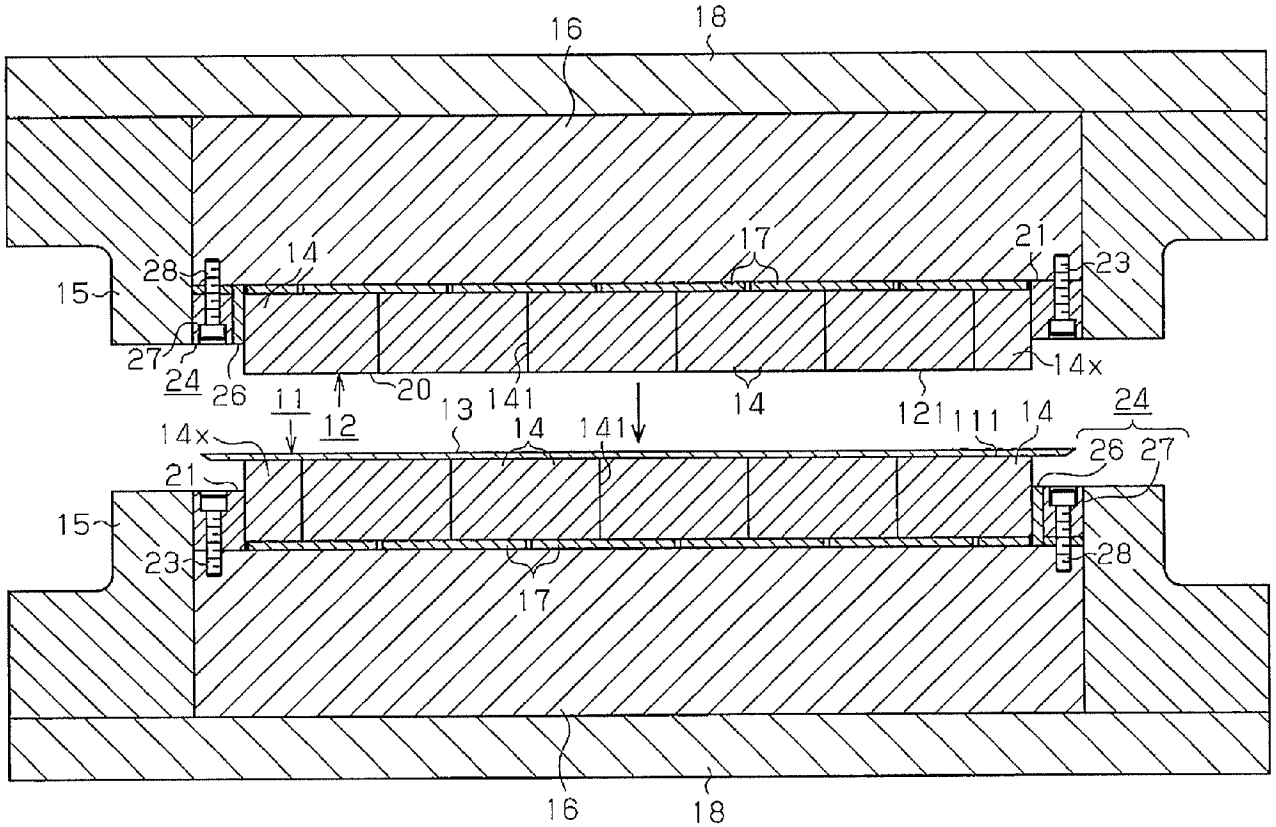
FIG. 1 is a cross-sectional view showing a press die machine according to a first embodiment.
Figure 3:
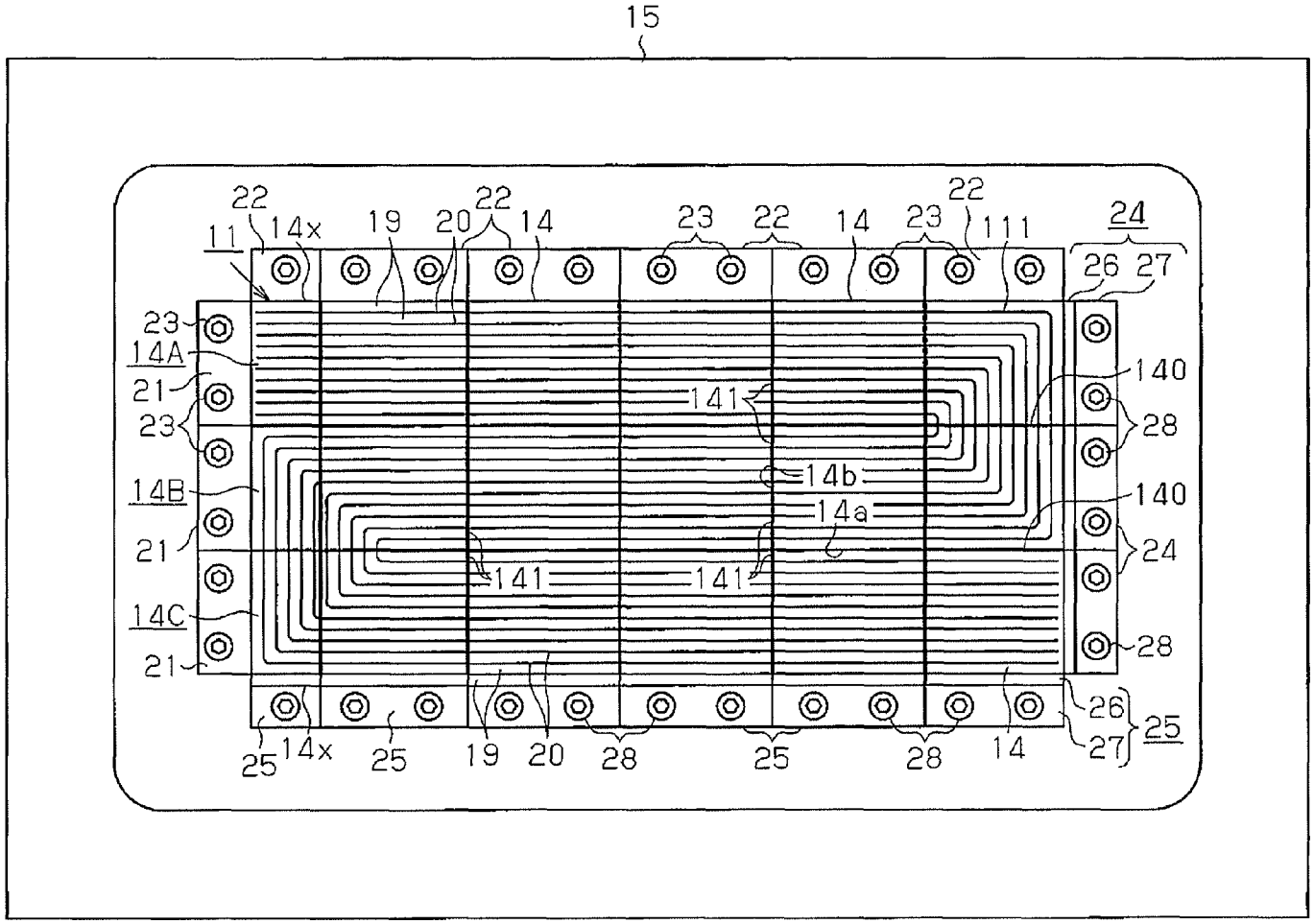
FIG. 3 is a plan view showing a lower press die of the press die machine shown in FIG. 1.
Figure 4:
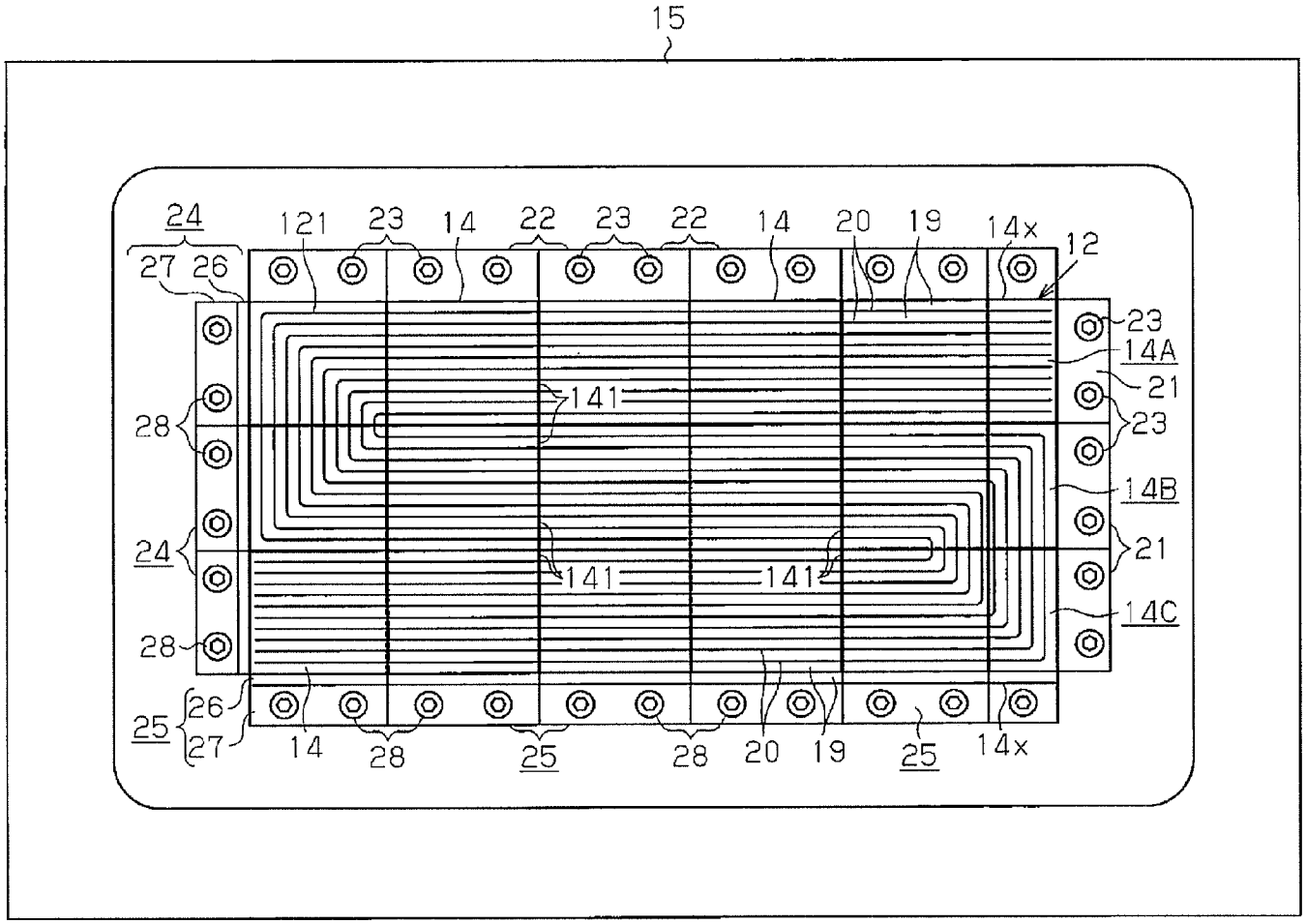
FIG. 4 is a plan view showing an upper press die of the press die machine shown in FIG. 1.

As shown in FIGS. 1, 3 and 4, the press die machine of this embodiment is provided with a lower press die 11 and an upper press die 12, which is capable of moving closer to and away from the lower press die 11. Indented die faces 111, 121 are formed respectively on the upper face of the lower press die 11 and the lower face of the upper press die 12 to be fitted together. The upper press die 12 is moved toward the lower press die 11, by which a plate member 13 is pressed into a predetermined shape between the die faces 111, 121 of the press dies 11, 12.

As shown in FIGS. 1 and 3, the lower press die 11 is configured to be divided into a plurality of square-column shaped segments 14. The segments 14 are arranged on a base 16 by way of shims 17 inside a frame 15 having a rectangular shape when viewed from above. The frame 15 and the base 16 are fixed on a support plate 18. The segments 14 constitute a plurality of segment rows 14A, 14B, 14C (three rows in this embodiment) extending in a predetermined direction (lateral direction as viewed in FIG. 1 in the embodiment). The segment rows 14A, 14B, 14C are arranged side by side in a direction (in the back and forth direction) orthogonal to the predetermined direction inside the frame 15. A segment 14*x*, which is formed to be shorter than each segment 14 in the extending direction of the rows, is included in each of the segment rows 14A, 14B, 14C.

As shown in FIG. 3, first joint portions 141 extending in a direction in which the segment rows 14A, 14B, 14C are arranged side by side are formed between adjacent segments 14, 14*x*. Further, second joint portions 140 extending in a direction in which the rows extend are formed between adjacent segment rows 14A, 14B, 14C. Each of the first joint portions 141 in a direction in which the rows extend is set to be arranged at an equal interval between adjacent segment rows 14A, 14B, 14C. Each segment 14*x*, which is shorter in the direction in which the rows extend, is arranged at a first end portion of each of the segment rows 14A, 14B, 14C. In all the segment rows 14A, 14B, 14C, the joint portions 141, 140 between any two adjacent segments 14, 14*x* are formed to intersect a lengthwise direction and a horizontal direction. These joint portions 141, 140 may be referred to as joint lines 141, 140.

Figure 5:
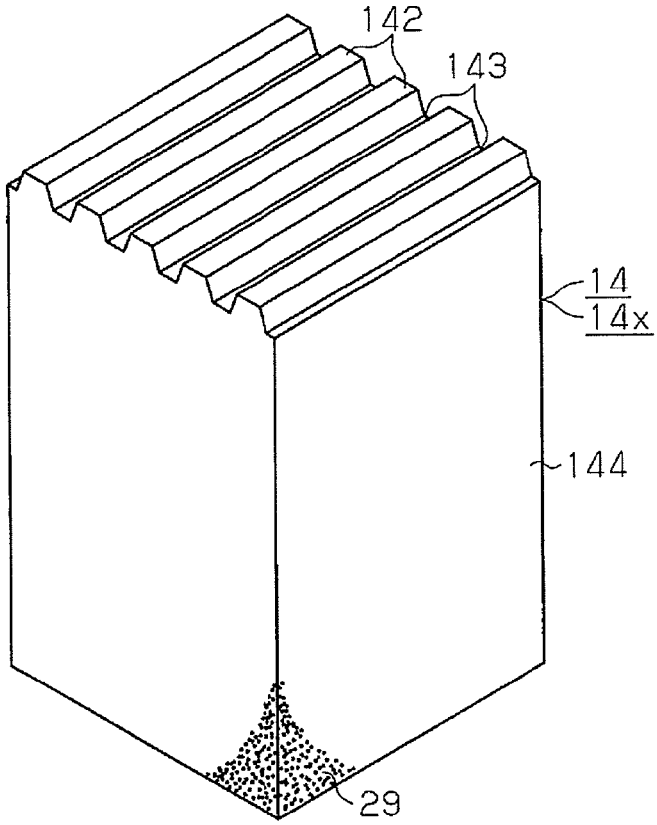
FIG. 5 is a perspective view showing a segment of the press die.

As shown in FIG. 5, a plurality of protrusions 142 and a plurality of grooves 143 are formed alternately on each surface of the segments 14, 14*x*. In a state in which the segments 14, 14*x* are arranged in each of the segment rows 14A, 14B, 14C, these protrusions 142 and the grooves 143 are arranged continuously. Thereby, as shown in FIG. 3, protrusions 19 and grooves 20 are formed on the die face 111 of the lower press die 11. On the entire die face 111 of the lower press die 11, the protrusions 19 and the grooves 20 are flexed backward by 180 degrees at two sites of the ends of the die face 111, that is, at first end portions of two segment rows 14B, 14C and at second end portions of the two segment rows 14A, 14B on the opposite side of the first end portions and extended continuously. Therefore, the protrusions 142 and the grooves 143 of each of the segments 14, 14*x* extend in a direction orthogonal to the first joint line 141 except for the segments 14, 14*x* at flexed portions of the first and the second end portions.

According to the above-described configuration, the protrusions 142 and the grooves 143 are cut on each surface of the segments 14, 14*x* that is narrow in area. The segments 14, 14*x* are aligned to integrate the protrusions 142 and the grooves 143 of the segments 14, 14*x*. Thereby, the indented die face 111 is formed to facilitate cutting of the die face 111.

As shown in FIGS. 1 and 3, a block-like space member 21 is placed between a left-side portion of the frame 15 and each segment 14*x*, which face each other in the longitudinal direction of the frame 15 of the lower press die 11. Further, a block-like space member 22 is placed between a rear-side portion of the frame 15 and each of the segments 14, 14*x* of the segment row 14A, which face each other in the transverse direction of the frame 15. These space members 21, 22 are fixed to the base 16 with screws 23.

As shown in FIGS. 1 and 3, a wedge 24 is placed between a right-side portion of the frame 15 and the second end portion of each of the total three segments 14, which face each other in the longitudinal direction of the frame 15. A wedge 25 is placed between a front-side portion of the frame 15 and each of the segments 14, 14*x* of the segment row 14C, which face each other in the transverse direction of the frame 15. The wedges 24, 25 are similar in configuration and also provided with a first wedge member 26 arranged to be adjacent to each of the segments 14, 14*x* and a second wedge member 27 arranged to be adjacent to the frame 15. As shown in FIG. 1, each of the second wedge members 27 is fixed to the base 16 with a screw 28. A face of each of the first wedge members 26 in contact with each of the second wedge members 27 is inclined to provide wedge effects. Due to the wedge effects of each of the wedges 24, 25, the segments 14, 14*x* arranged in the longitudinal direction and in the transverse direction inside the frame 15 are pressed toward the corresponding space members 21, 22, by which they are fixed in an aligned manner.

As shown in FIG. 4, as with the lower press die 11, the upper press die 12 is also formed to be divided into a plurality of square column-shaped segments 14, 14*x*. Each of the segments 14, 14*x* of the upper press die 12 shown in FIG. 4 is formed such that each of the segments 14, 14*x* of the lower press die 11 shown in FIG. 3 is rotated by 180 degrees about the rotation center that is an axis orthogonally intersecting the die faces 111, 121. Except for the above description, each of the segments 14, 14*x* of the lower press die 11 is similar in configuration to each of the segments 14, 14*x* of the upper press die 12.

Figure 2:
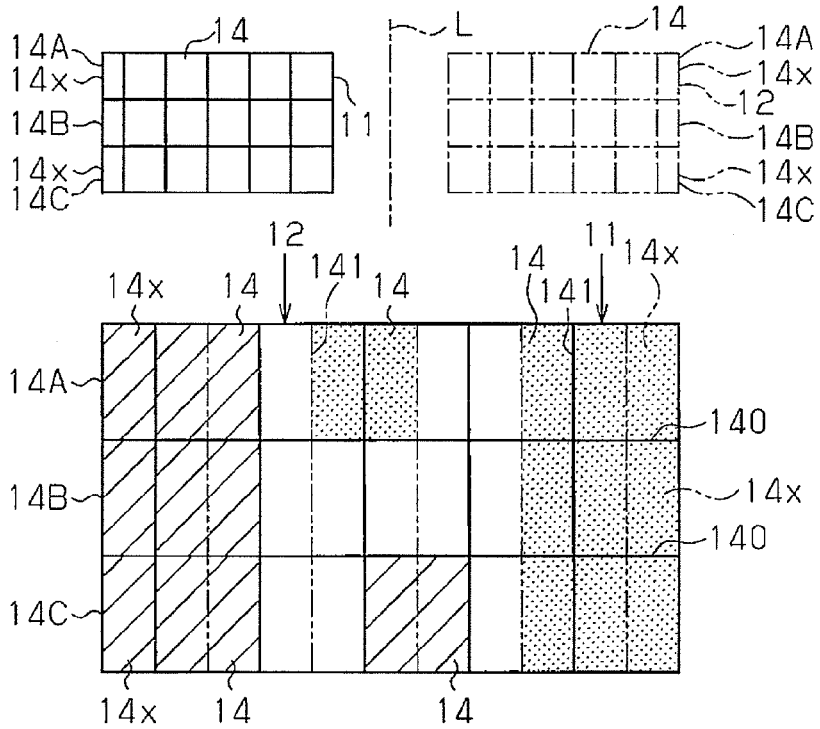
FIG. 2 is a diagram showing a positional relationship of joint portions of an upper and lower press die machine.

As shown in FIG. 2, the segments 14, 14*x* of the upper press die 12 are arranged to be symmetrical to the lower press die 11 with respect to line L inside the frame 15. Therefore, as shown in FIGS. 1 and 2, the first joint portions 141 between the segments 14, 14*x* on the segment rows 14A, 14B, 14C of the upper press die 12 are arranged to be offset from the first joint portions 141 between the segments 14, 14*x* on the segment rows 14A, 14B, 14C of the lower press die 11. That is, as shown in FIG. 3, each segment 14*x* of the lower press die 11, which is narrow in the length direction of the lower press die 11, is positioned at the first end portion (left end portion) in a direction in which the segments 14, 14*x* are arranged. In contrast, as shown in FIG. 4, each segment 14*x* of the upper press die 12, which is narrow, is arranged to be positioned at the second end portion (right end portion) in a direction in which the segments 14, 14*x* are arranged. Thereby, as shown in FIG. 2, each first joint portion 141 between two adjacent segments 14, 14*x* in each of the segment rows 14A, 14B, 14C of the upper press die 12 is arranged to be positioned at an intermediate portion of the segment 14 in one of the segment rows 14A, 14B, 14C of the lower press die 11 when the press dies 11, 12 face each other. In a similar manner, each first joint portions 141 between two adjacent segments 14, 14*x* in each of the segment rows 14A, 14B, 14C of the lower press die 11 is arranged to be positioned at an intermediate portion of one of the segments 14 in one of the segment rows 14A, 14B, 14C of the upper press die 12 when the press dies 11, 12 face each other.

In FIG. 2, the segments 14, 14*x* of the lower press die 11 are partially indicated by using slashes, while the segments 14, 14*x* of the upper press die 12 are partially indicated by using dots.

Operation of the press die machine of the present embodiment will now be described.

While the press die machine is in operation, as shown in FIG. 1, in a state in which the plate member 13 is between the press dies 11, 12 and arranged on the lower press die 11, the upper press die 12 is moved toward the lower press die 11. Thereby, the plate member 13 is pressed between the die faces 111, 121 of the press dies 11, 12, by which the plate member 13 is pressed into a predetermined shape. Upon pressing of the plate member 13, a strong pressing force is exerted on each of the segments 14, 14*x* of the press dies 12, 11, and middle portions on side walls of the segments 14, 14*x* undergo deformation to expand outward. In this case, at the segments 14, 14*x* in which the protrusions 142 and the grooves 143 are extended linearly, that is, at the segments 14, 14*x* in which flexed portions of the protrusions 142 and the grooves 143 are not formed, the die face having the protrusions 142 and the grooves 143 is likely to spread in a direction (vertical direction in FIG. 3) in which the protrusions 142 and the grooves 143 are arranged. Therefore, a middle portion (refer to FIG. 3) of a first side face 14*a* of the segments 14, 14*x* along the second joint portion 140 resists expansion, and a gap is less likely to develop between the two segments 14, 14*x* with which the first side face 14*a* is in contact. At this time, at the segments 14, 14*x*, a middle portion of a second side face 14*b* (a side face orthogonal to the first side face 14*a*), which intersects the direction in which the protrusions 142 and the grooves 143 extend, is likely to expand.

Figure 13:
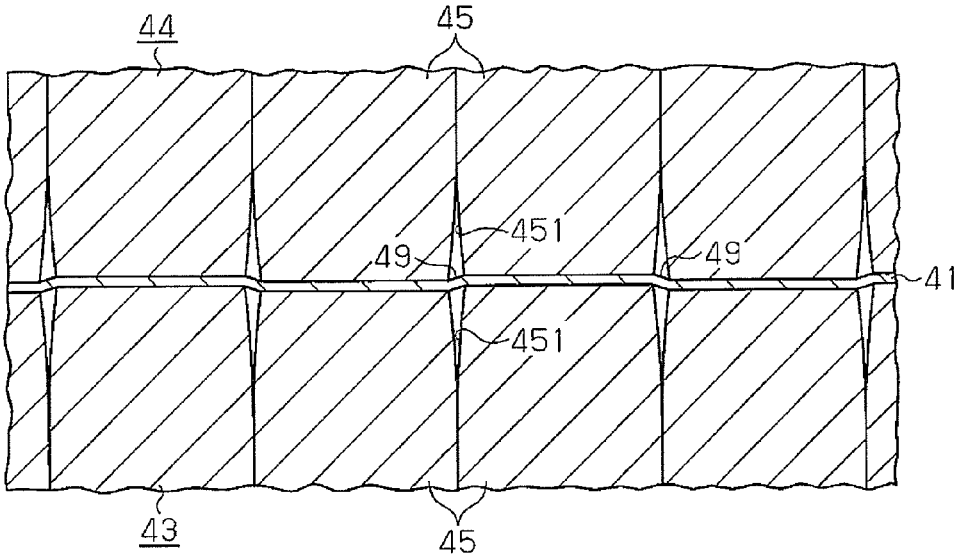
Fig.13(Prior Art)
FIG. 13 is a partially-enlarged cross-sectional view showing an operating state of the press die machine shown in FIG. 12.

In the present embodiment, as shown in FIG. 2, the first joint portions 141 of the segments 14, 14*x* at the segment rows 14A, 14B, 14C are arranged to be offset between the press dies 12, 11. Thereby, the first joint portions 141 between two adjacent segments 14, 14*x* in a direction in which the segment rows 14A, 14B, 14C of one of the press dies 11, 12 are arranged are arranged at intermediate portions of the segments 14, 14*x* in the segment rows 14A, 14B, 14C of the other of the press dies 12, 11. Therefore, even where the middle portions of the side faces 14*a*, 14*b* in the segments 14, 14*x* undergo deformation to expand outward and, in particular, the middle portion of the second side face 14*b* intersecting the direction in which the protrusions 142 and the grooves 143 extend is likely to expand. Even where a gap is likely to develop in a part of the first joint portions 141, an integrated gap does not develop in a vertical direction on the plate member 13, which is positioned between the both press dies 11, 12, unlike the conventional case shown in FIG. 13. Thereby, it is possible to restrain development of a step on the plate member 13 along the first joint portion 141 between the segments 14, 14*x*. Further, since the die face of the segments 14, 14*x* spreads at a position of the second joint portion 140, the first side face 14*a* does not expand significantly at a middle portion thereof. Thus, few gaps are formed between the segments 14, 14*x* and, therefore, no step is substantially formed on the plate member 13.

The present embodiment achieves the following advantages.

(1) In this embodiment, the plate member 13 is pressed by using the press dies 11, 12, which arrange the segments 14, 14*x* side by side for forming the die faces 111, 121. The joint portions 141 of the segments 14, 14*x* are arranged to be offset between one of the press dies 11, 12 and the other of the press dies 12, 11.

According to the above-described configuration, the first joint portions 141 between adjacent segments 14, 14*x* are not arranged to correspond to each other but arranged to be positioned at different sites between the press dies 11, 12. Thereby, it is possible to avoid development of gaps at positions between adjacent segments 14, 14*x* and at corresponding positions in the press dies 11, 12. As a result, it is possible to restrain development of steps and irregularities on the plate member 13 along the first joint portions 141 between the segments 14, 14*x*.

(2) The press dies 11, 12 have symmetrical shapes. It is, therefore, possible to use the segments 14, 14*x* identical in shape in the upper and lower press dies 11, 12, making it possible to reduce the number of types of components.

(3) The joint lines 141 of one of the press dies 11, 12 are positioned at intermediate portions of the segments 14, 14*x* of the other of the press dies 12, 11. Therefore, it is possible to alleviate the concentration of stress resulting from die pressure at a specific site. As a result, it is possible to perform pressing at high accuracy and also improve the durability of the segments 14, 14*x*.

(4) In the segments 14, 14*x*, a middle portion of the second side face 14*b* intersecting the direction in which the protrusions 142 and the grooves 143 extend, in other words, a middle portion of a side face along a direction in which the first joint portion 141 extends is likely to expand. Therefore, a gap is likely to develop at this part. However, in the present embodiment, the joint lines 141 of the press dies 11, 12 are not arranged to be in alignment, thus, making it possible to effectively prevent formation of steps on the plate member 13.

Second Embodiment

A press die machine according to a second embodiment will now be described. The differences from the first embodiment will mainly be discussed.

Figure 6:
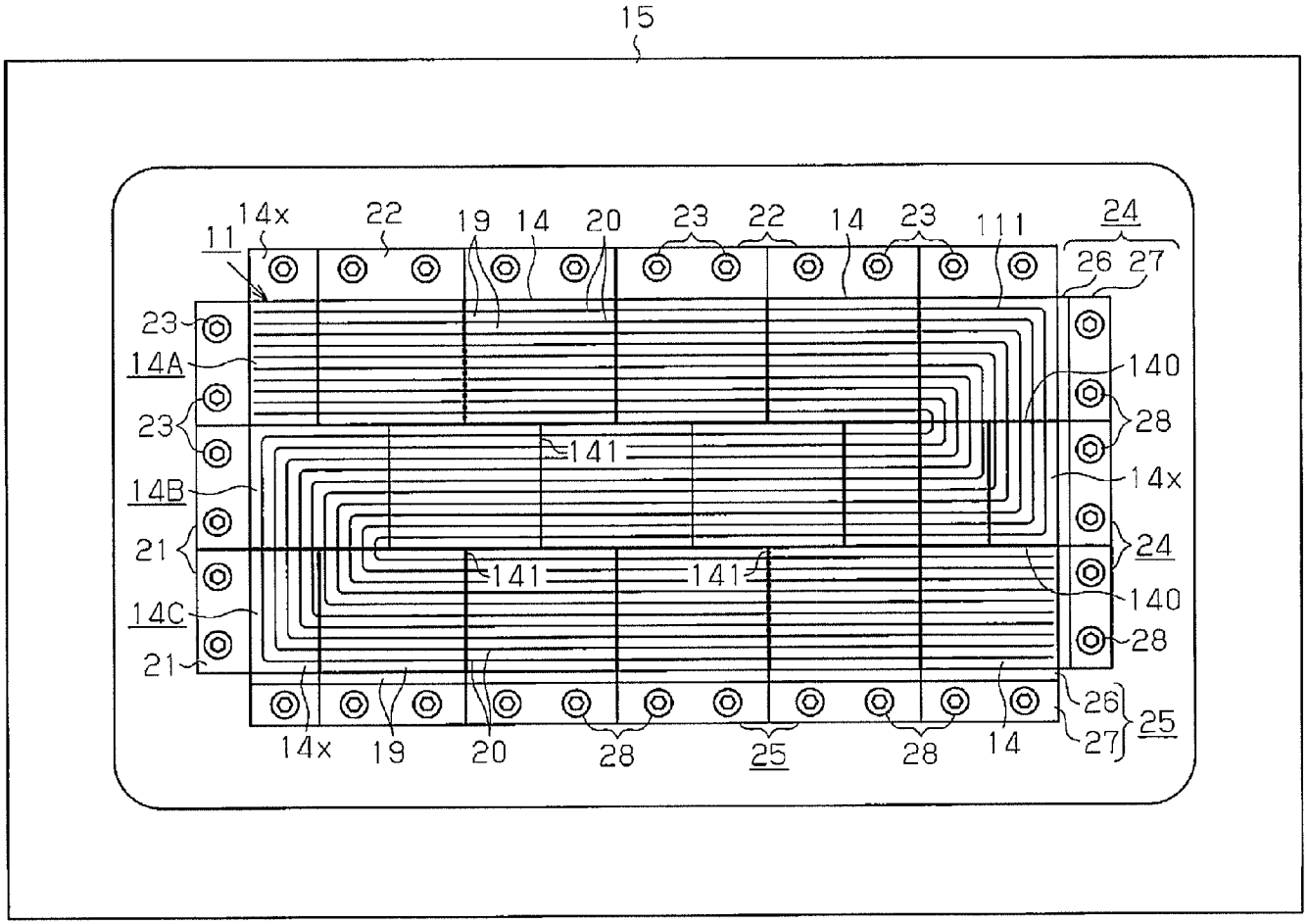
FIG. 6 is a plan view showing a lower press die of a press die machine according to a second embodiment.
Figure 7:
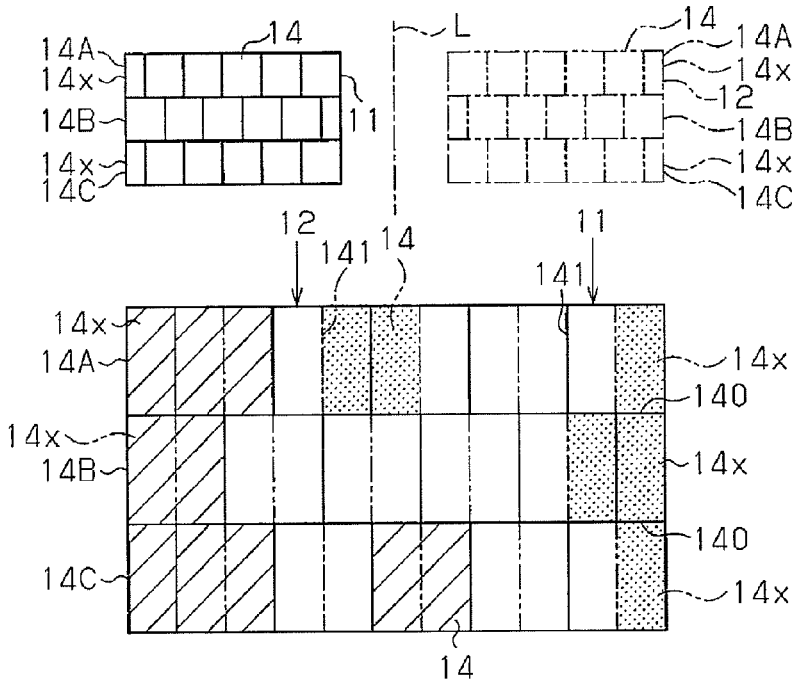
FIG. 7 is a diagram showing a positional relationship of joint portions of the press die machine of the second embodiment.

In the second embodiment, as shown in FIGS. 6 and 7, joint portions 141 of segments 14, 14*x* are arranged to be offset between two adjacent segment rows 14A, 14B, 14C of each of press dies 11, 12. That is, at the segment rows 14A, 14C on both sides of the lower press die 11 shown in FIG. 6, the segment 14*x*, which is narrower, is arranged at a first end portion thereof in the arranged direction. At the segment row 14B at the center, the segment 14*x*, which is narrow, is arranged at a second end portion thereof in the arranged direction. In contrast, at the segment rows 14A, 14C on both sides of the upper press die 12 as shown in the upper right section of FIG. 7, the segment 14*x*, which is narrow, is arranged at a second end portion in the arranged direction (the end opposite to that in the case of the lower press die 11) and at the segment row 14B at the center, the segment 14*x*, which is narrow, is arranged at a first end portion thereof in the arranged direction. Thereby, between two adjacent segment rows 14A, 14B and the segment rows 14B, 14C, each of the first joint portion 141 of one of the segment rows 14A, 14B is arranged to correspond to an intermediate portion between two first joint portions 141 adjacent to the other of the segment rows 14B, 14C.

As shown in FIG. 5, in the second embodiment, a metal protective coating 29 is provided on a circumference side face 144 of each of the segments 14, 14*x*. Thereby, when a plate member 13 is pressed, a corner portion at which the segments 14, 14*x* are met or the like is in contact with side faces 144 of the segments 14, 14*x* at other adjacent segment rows 14A to 14C, the side faces 144 of the segments 14, 14*x* are less likely to be damaged.

In addition to the advantages (1) through (4) of the first embodiment, the second embodiment provides the following advantages.

(5) In the second embodiment, the first joint portions 141 of the segments 14, 14*x* between adjacent ones of the segment rows 14A to 14C are arranged to be offset in each of the press dies 11, 12. Therefore, between the adjacent ones of the segment rows 14A to 14C, the first joint portions 141 are not arranged continuously in a direction in which the segment rows 14A to 14C are arranged, but arranged to be positioned at different sites. Thereby, when the plate member 13 is pressed, corners at which the segments 14, 14*x* are met can be prevented from colliding with each other between the adjacent segment rows 14A to 14C. It is, therefore, possible to reduce the likelihood of damages to the corners at which the segments 14, 14*x* are met.

(4) A protective coating 29 is provided on a circumference side face 144 of each of the segments 14, 14*x*. Therefore, upon pressing of the plate member 13, the corners at which the segments 14, 14*x* are met or the like are unlikely to contact the circumference side faces 144 of the segments 14, 14*x* at a different one of the segment rows 14A to 14C between the adjacent segment rows 14A to 14C. This reduces the likelihood of damage to the circumference side faces 144.

Modifications

The above described embodiments may be modified as follows.

Figure 8:
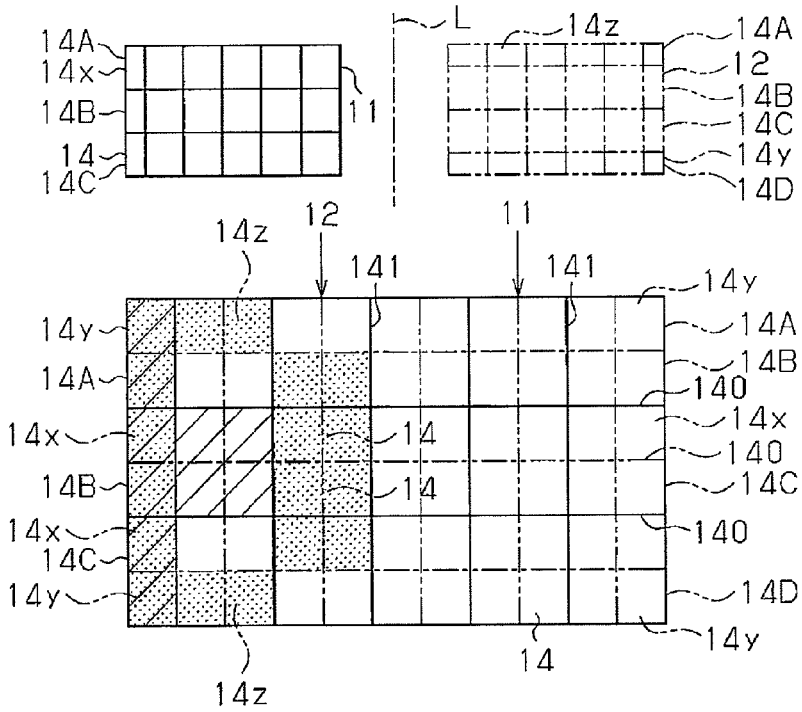
FIG. 8 is a diagram showing a positional relationship of joint portions of a press die machine of a modified embodiment.

As shown in FIG. 8, in addition to such the configuration of the first embodiment, in which the first joint portions 141 of the segments are made different between adjacent segment rows 14A to 14C, segments 14*y*, 14*z* that are narrow in the transverse direction of the die may be used at least in one of the lower press die 11 and the upper press die 12. Thereby, second joint portions 140 of the segment rows 14A to 14C (in FIG. 8, one of the dies has the segment rows that are 14A to 14D) deviate between the press dies 11, 12. Therefore, the second joint portions 140 that are joint portions between the adjacent segment rows 14A to 14C of the lower press die 11 are positioned at middle portions of two second joint portions 140 that are adjacent to each other between the segment rows 14A to 14D of the upper press die 12.

Figure 9:
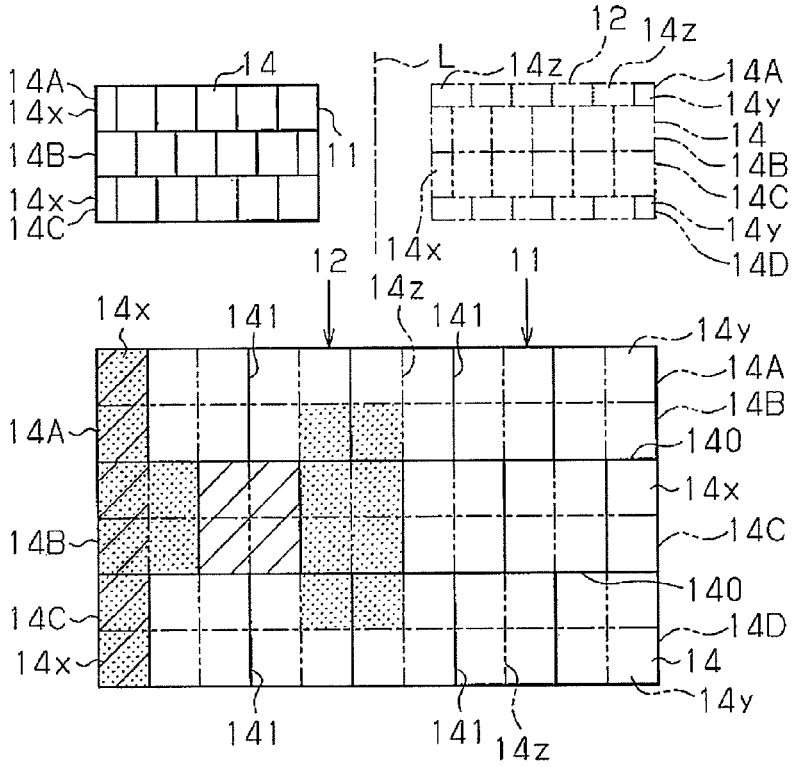
FIG. 9 is a diagram showing a positional relationship of joint portions of a press die machine of another modified embodiment.
Figure 10:
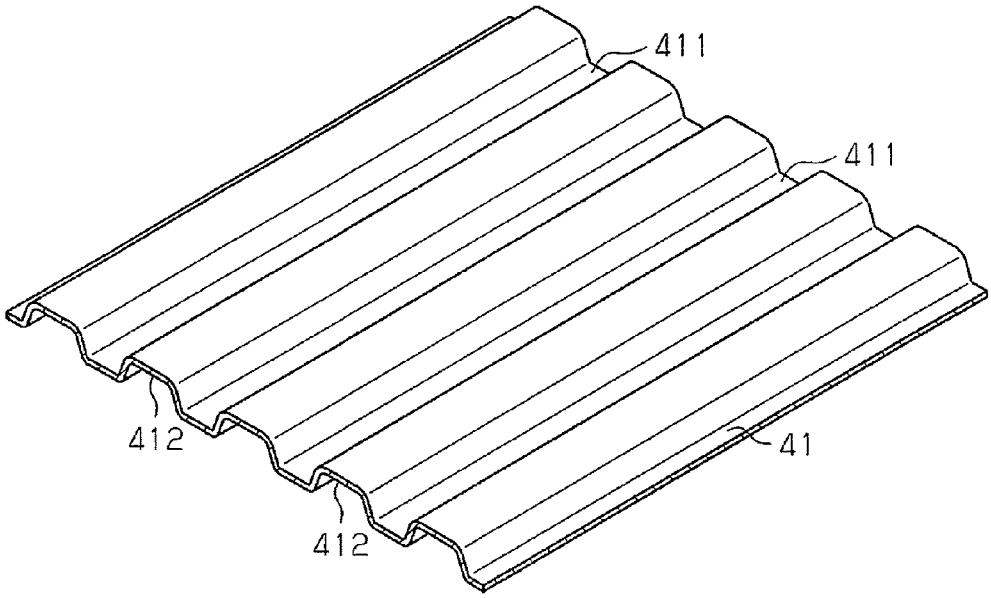
Fig.10(Prior Art)
FIG. 10 is a partial perspective view showing a fuel-cell separator.
Figure 11:
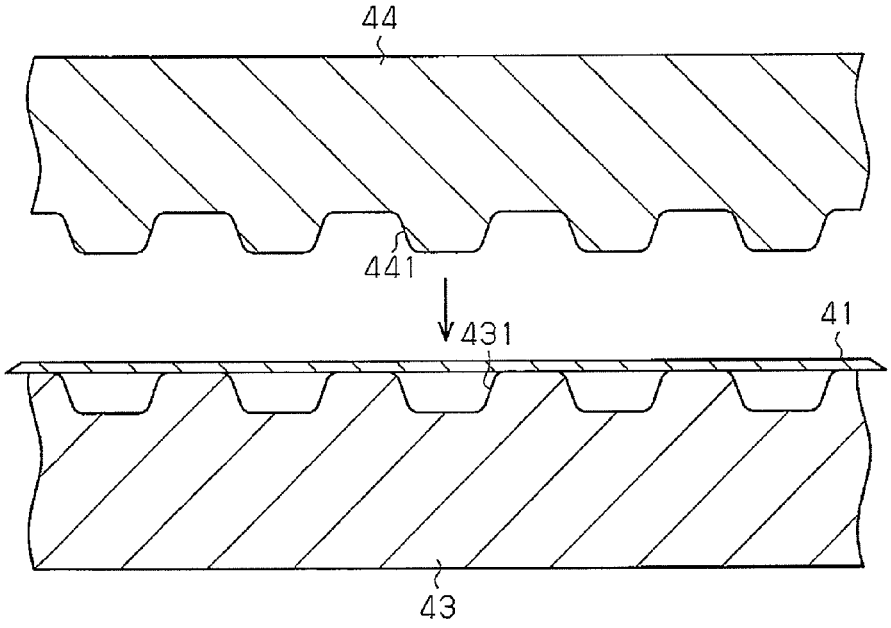
Fig.11(Prior Art)
FIG. 11 is a cross-sectional view showing a conventional press die machine for forming the fuel-cell separator shown in FIG. 6.
Figure 12:
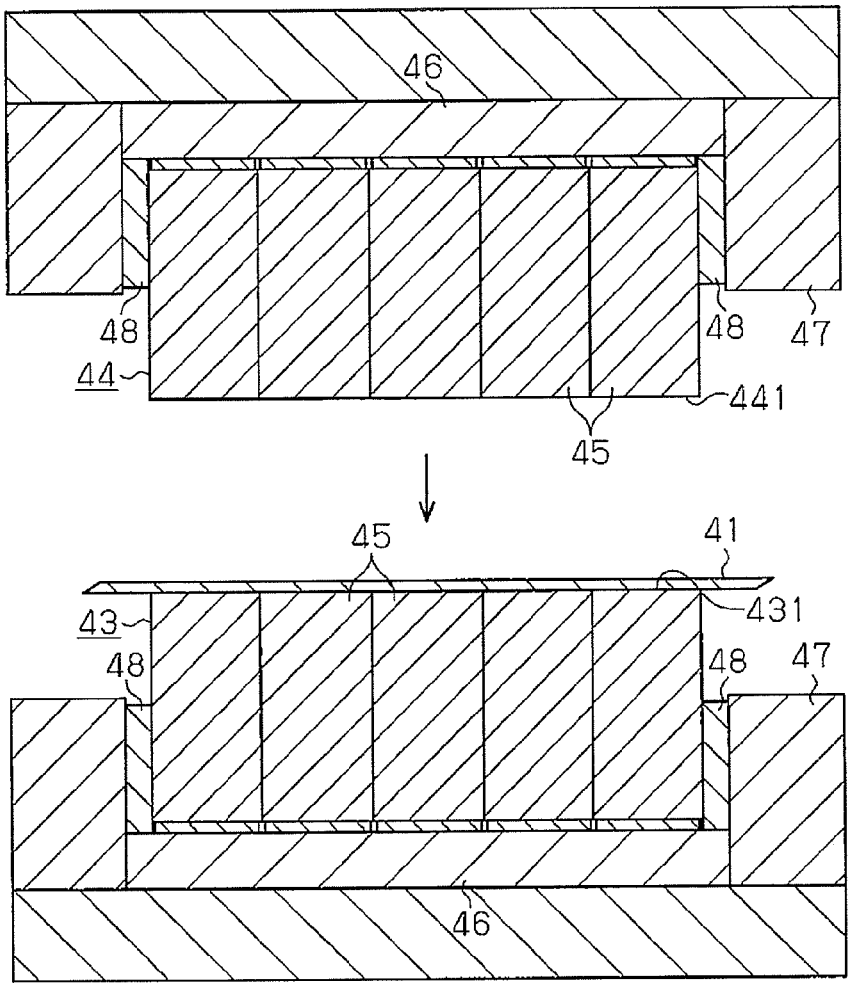
Fig.12(Prior Art)
FIG. 12 is a cross-sectional view showing another configuration of the conventional press die machine.

As shown in FIG. 9, it is also acceptable that the configuration shown in FIG. 7 is combined with the configuration shown in FIG. 8. That is, such a configuration is acceptable that first joint portions 141 of segments 14, 14*x*, 14*y*, 14*z* are arranged to be offset between adjacent segment rows 14A, 14B, 14C inside both dies 11, 12, and joint portions 140, 141 of the segments 14, 14*x* are arranged to be offset also between the press dies 11, 12.

Such a configuration is acceptable in which the segments 14, 14*x*, 14*y*, 14*z* are changed in size and number of arranged segments.

It is acceptable that the segment is formed in as triangular pillars or hexagonal pillars.

Although a plurality of segment rows are provided in the above illustrated embodiments, only one segment row may be provided. This configuration is also able to give actions and effects similar to those of the above illustrated embodiments by differentiating the positions of the first joint portions 141 between the press dies 11, 12.

As long as a first joint portion 141 of the upper press die 12 is between two adjacent first joint portions 141 of the lower press die 11, the first joint portion 141 thereof may be positioned at a site other than middle portions of the segments 14, 14*x* of the press die 11.

What is claimed is:

1. A press die machine for pressing a plate member, the press die machine comprising:

first and second press dies, each of the first and second press dies being defined by a plurality of segment rows arranged side by side that each include a plurality of segments that are fixed side by side in an aligned manner to define die faces, wherein joint portions of the first press die are defined between two mutually adjacent segments of the first press die, joint portions of the second press die are defined between two mutually adjacent segments of the second press die, of the joint portions of both press dies, joint portions that extend in a direction in which the plurality of segment rows are arranged are defined as first joint portions, the first joint portions are arranged to be offset from each other between two adjacent segment rows, and when the respective die faces of the first and second press dies face each other, the joint portions of the first press die and the joint portions of the second press die are arranged to be offset from each other.

2. The press die machine according to claim 1, wherein the joint portions of the second press die are arranged to correspond to middle portions of the segments of the first press die in a direction in which the segments of the first press die are arranged.

3. The press die machine according to claim 1, wherein protrusions and grooves, which extend in a direction in which the plurality of segments are arranged, are defined on the die faces of the respective press dies, the protrusions and the grooves being arranged alternately in a direction orthogonal to the arranged direction of the plurality of segments.

4. The press die machine according to claim 3, wherein of the joint portions of both press dies, joint portions which extend in a direction in which the protrusions and the grooves extend is defined as second joint portions, and the second joint portions are arranged at positions to be offset from each other between the first and second press dies.

5. The press die machine according to claim 1, wherein a coating is provided on a side face of each of the plurality of segments.

6. The press die machine according to claim 1, wherein the plurality of segments are press-fit to be fixed in the aligned manner.

* * * * *